US012173892B2

(12) United States Patent
Kreca

(10) Patent No.: US 12,173,892 B2
(45) Date of Patent: Dec. 24, 2024

(54) PROCESS AND DEVICE FOR IMPROVING OF SYNTHESIS AND/OR FLUE GAS VELOCITY FIELD FOR REFUSE DERIVED FUEL APPLICATIONS

(71) Applicant: GRID POWR AG, Zug (CH)

(72) Inventor: Ivo Kreca, Vransko (SI)

(73) Assignee: GRID POWER AG, Zug (CH)

( * ) Notice: Subject to any disclaimer, the term of this patent is extended or adjusted under 35 U.S.C. 154(b) by 875 days.

(21) Appl. No.: 17/269,277

(22) PCT Filed: Aug. 23, 2018

(86) PCT No.: PCT/SI2018/050028

§ 371 (c)(1),
(2) Date: Feb. 18, 2021

(87) PCT Pub. No.: WO2020/040703

PCT Pub. Date: Feb. 27, 2020

(65) Prior Publication Data

US 2021/0254825 A1 Aug. 19, 2021

(51) Int. Cl.

| | |
|---|---|
| ***F23B 80/04*** | (2006.01) |
| ***F22B 13/14*** | (2006.01) |
| ***F23G 5/027*** | (2006.01) |
| ***F23G 5/16*** | (2006.01) |

(52) U.S. Cl.

CPC ..... *F23B 80/04* (2013.01); *F22B 13/14* (2013.01); *F23G 5/0276* (2013.01); *F23G 5/165* (2013.01); *F23D 2203/007* (2013.01); *F23G 2201/40* (2013.01); *F23G 2202/103* (2013.01); *F23G 2203/101* (2013.01); *F23G 2207/103* (2013.01); *F23G 2900/55003* (2013.01); *F23G 2900/55011* (2013.01)

(58) Field of Classification Search

CPC ..... F23B 80/04; F22B 13/14; F23G 5/0276; F23G 5/165; F23G 2201/40; F23G 2202/103; F23G 2203/101; F23G 2207/103; F23G 2900/55003; F23G 2900/55011; F23D 2203/007

See application file for complete search history.

(56) References Cited

U.S. PATENT DOCUMENTS

2016/0018130 A1* 1/2016 Schmitt ..... F23M 9/003 110/162

FOREIGN PATENT DOCUMENTS

| | | | | |
|---|---|---|---|---|
| DE | 19730227 A1 * | 1/1999 | ..... | F23G 5/002 |
| JP | S59167129 A | 9/1984 | | |
| JP | S6414512 A | 1/1989 | | |
| JP | 2002206720 A | 7/2002 | | |
| WO | 94/15148 A1 | 7/1994 | | |

* cited by examiner

*Primary Examiner* — David J Laux
(74) *Attorney, Agent, or Firm* — Maschoff Brennan

(57) ABSTRACT

Process and device for improving of synthesis and/or flue gas velocity field solves technical problem of local increase of velocity and resulting non-homogeneous flue gas field resulting in uneven temperature and concentration distribution within flue gas field by providing for homogenization of flue gas field using strategically placed obstacles in the flow field such as flaps or similar devices.

5 Claims, 3 Drawing Sheets

PROCESS AND DEVICE FOR IMPROVING OF SYNTHESIS AND/OR FLUE GAS VELOCITY FIELD FOR REFUSE DERIVED FUEL APPLICATIONS

CROSS-REFERENCE TO RELATED APPLICATION

This application is related to and claims the benefit of priority of International Application No. PCT/SI2018/050028, entitled, "Process and Device for Improving of Synthesis and/or Flue Gas Velocity Field for Refuse Derived Fuel Applications", filed on Aug. 23, 2018, which is hereby incorporated by reference.

BACKGROUND INFORMATION

1. Field

The present disclosure relates to refuse derived fuel, and more specifically to homogenization of the flue gas field.

2. Background

There are many systems for production of synthesis gas in existence, however, these systems experience local recirculation and/or increase of velocity of flue gases which reduces effectiveness of the solution.

WO2012154133 describes a process featuring separate gasification and combustion on the same moving grate. The grate can also be manufactured as a cascade, having air injected under the moving grate. Above the grate the combustion chamber is separated into two parts into which the air is injected. The fuel is additionally heated and gasified by passing hot flue gases, recirculation or steam injection through the fuel. The device is designed to allow exit of synthesis gas through the exhaust outlet and further use of it or mixing with other final incineration flue gases in the final combustion chamber.

SUMMARY

An illustrative embodiment provides a method for improving flow of synthesis and/or flue gas in refuse derived fuel (RDF) application such as waste incinerator. The method comprises the steps of: providing for assessment of local velocity profile of synthesis and/or flue gas flowing at a predetermined position within a primary and/or secondary chamber; if said assessment results in excess local velocity difference of said synthesis and/or flue gas in direction essentially transverse to general direction of flow of said synthesis and/or flue gas above a predetermined value, providing for obstacle to be placed at or in proximity to said predetermined position; measuring of process parameters of said flow such as percentage of oxygen or temperature of said flue gas or composition of RDF or moisture content or combination thereof at least one point along said gas path, said point chosen from the group consisting of entrance to secondary chamber, entrance of flue gas channel, entrance of gas side of steam generator, any position along said gas path, or plurality, or combination thereof; arranging at least one hinged obstacle in flue gas channel; and rotating of said at least one hinged obstacle to a position depending on measurements of process parameters of said flow such as percentage of oxygen or temperature of said flue gas or composition of RDF or moisture content or combination thereof at least one point along said gas path, said point chosen from the group consisting of entrance to secondary chamber, entrance of flue gas channel, entrance of gas side of steam generator, any position along said gas path, or plurality, or combination thereof, or depending on experience of an operator.

Another illustrative embodiment provides a device for improving flow of synthesis and/or flue gas in refuse derived fuel (RDF) application such as waste incinerator for carrying out process according to any of previous claims, characterized in that there is at least one obstacle positioned in a flue gas channel.

The features and functions can be achieved independently in various embodiments of the present disclosure or may be combined in yet other embodiments in which further details can be seen with reference to the following description and drawings.

BRIEF DESCRIPTION OF THE DRAWING

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawing, wherein:

DETAILED DESCRIPTION

Figure 1:
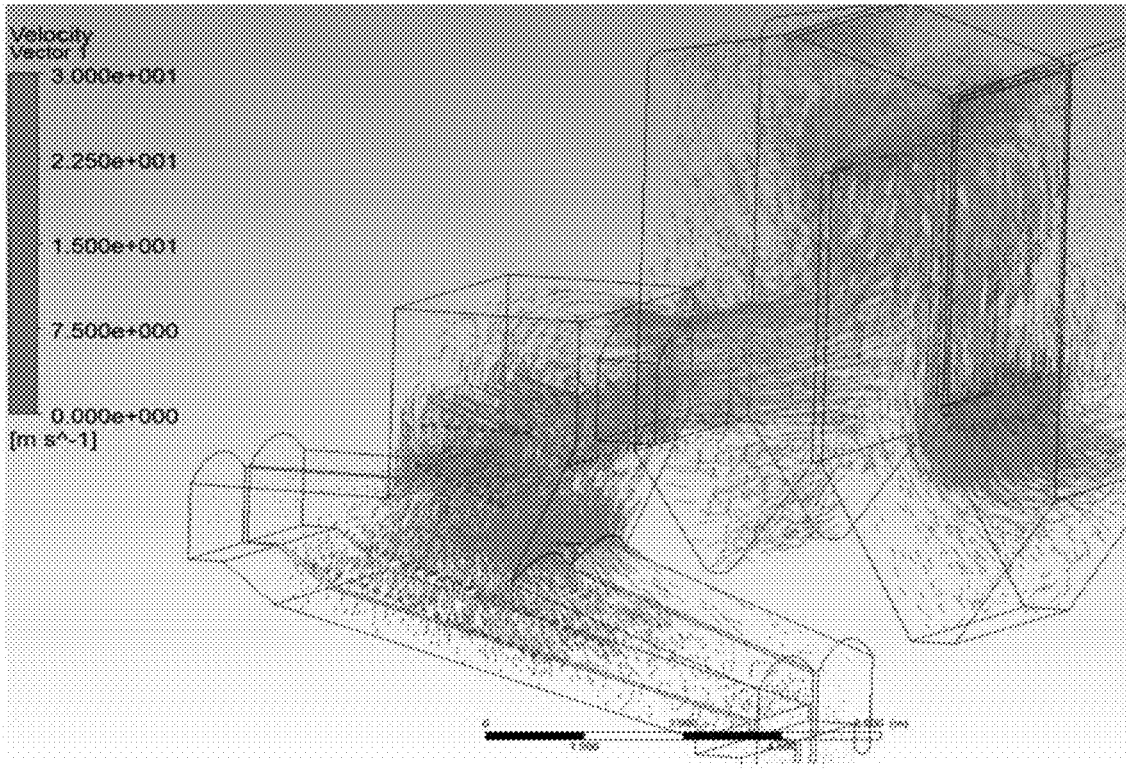
FIG. 1 shows velocity field as computed by available computational fluid mechanics means without obstacles.

The illustrative embodiment deals with refuse derived fuel ("RDF") or other type of waste or similar matter which is to be incinerated and generates more energy than used for decomposition.

The technical problem to be solved by present invention is relatively low effectiveness of gasification process with combustion in the secondary chamber and efficiency of high pressure steam generator. This technical problem can be traced to local increase of velocity and resulting non-homogeneous flue gas field resulting in uneven temperature and concentration distribution within flue gas field.

In particular, there are several problems which are to be solved, such as:

- demanding control of primary air injection as well as secondary and tertiary air;
- control of local velocity of synthesis gas and flue gas, particularly in so called exposed positions;
- said velocity increases many-fold on these exposed positions resulting in more problematic gasification and combustion processes;
- result of increased velocity of said flue gas and synthesis gas increases uptake of solid particles impeding the process;
- increase in solid particles results in abrasion and possible damage in secondary combustion and steam generator parts of the system;
- increase in solid particles requires higher quantity of additives increasing operating costs.

Process and device for improving of synthesis and/or flue gas velocity field solves above referenced technical problem by providing for homogenization of flue gas field using strategically placed obstacles in the flow field such as flaps or similar devices.

This system deals with refuse derived fuel ("RDF") or other type of waste or similar matter which is to be incinerated and generates more energy than used for decomposition.

There are several RDF systems in use. For example, two stage gasification is comprised of primary chamber in which incinerated matter such as waste or similar is converted into basic gases such as methane (CH4), carbon monoxide (CO), and hydrogen (H2). Gasification is thermos-chemical transformation of part of incinerated matter such as waste or similar into synthesis gas in reduced oxygen atmosphere at temperatures of about 600-800° C.

The second chamber features oxidizing of synthesis gas with addition of secondary or tertiary air at higher temperatures such as about 1000 to 1200° C. In order to achieve oxidation as well as thermal disintegration of organic matter appropriate mixing of secondary, and tertiary air with synthesis gas should be achieved. This, however, is a process which also depends on velocity, concentration, and temperature fields within said chambers as well as on combustion time.

Flue gases from said secondary chamber enter high pressure steam generator to generate high pressure steam according to requested process parameters for use in further processes such as driving a turbine or use in various processes.

Preferred embodiment of subject of this invention provides for

- A large area of operation according to CV 9-20 MJ/kg;
- Due to the low emission of dust in the primary chamber, the steam generator and the cleaning system are less loaded;
- Easy to adapt to fuel changes from 9-20 Mj/kg as well size and composition of RDF;
- System should be more compact and provide for modular building;
- Smaller capacity means lower financial risk;
- Acceptance by local population as it is directly related to their refuse.

The above referenced problem is solved by device for improving flow of synthesis and/or flue gas in refuse derived fuel (RDF) application such as waste incinerator, wherein there is at least one obstacle placed within at least primary chamber and/or secondary chamber of said RDF application, said obstacle resulting in reduction of local velocity difference of said synthesis and/or flue gas in direction essentially transverse to general direction of flow of said synthesis and/or flue gas when compared to local velocity difference of said synthesis and/or flue gas flowing through said primary and/or secondary chamber without said obstacle.

Local velocity profile can be obtained either by measuring or calculating by means of suitable computational flow dynamic method of computation of local velocities at predetermined position which can be in either primary or secondary chamber, or both, at various places such as narrowing or widening of cross section of said chamber or similar. If such local velocity difference exceeds predetermined value, for example 50%, between the highest and the lowest velocity excluding boundary layer, then an obstacle such as a flap, or grate, or bump, or similar device can be placed across path of said synthesis and/or flue gas in order to disrupt said flow resulting in vortices and disruption of the flow field. As a result, highest velocities within flow field are reduced in order for a processes to be carried on in more uniform flow field.

Depending on characteristics of the flow, device according to this invention can comprise at least one hinged obstacle positioned in or in proximity of said primary chamber. This hinged obstacle can be rotated to position which is determined by feedback of parameters measured at various points along the path of gas flow such as, for example, concentration of various constituents of flue gas, temperature of flue gas and similar, these points being, for example, at entrance into the secondary chamber, entrance into flue channel, entrance into steam generator or similar.

Device according to this invention can further comprise said at least one hinged obstacle which is rotated to assume position depending on measurements of process parameters of said flow such as percentage of oxygen or temperature of said flue gas at least one point along said gas path, said point chosen from the group consisting of entrance to secondary chamber, entrance of flue gas channel, entrance of gas side of steam generator, any position along said gas path, or plurality, or combination thereof.

Device according to this invention can further comprise at least one unhinged obstacle positioned in or in proximity of said primary chamber or in or in proximity of secondary chamber or in or in proximity of flue gas channel.

In order to carry on the invention, a process or improving flow of synthesis and/or flue gas in refuse derived fuel (RDF) application such as waste incinerator is created wherein said process is comprised of the following steps:

- providing for assessment of local velocity profile of synthesis and/or flue gas flowing at a predetermined position within primary and/or secondary chamber;
- if said assessment results in excess local velocity difference of said synthesis and/or flue gas in direction essentially transverse to general direction of flow of said synthesis and/or flue gas, providing for obstacle to be placed at or in proximity to said predetermined position.

Process according to this invention can further comprise the step of arranging a hinged obstacle in or in proximity to primary chamber.

Process according to this invention can further comprise the step of measuring of process parameters of said flow such as percentage of oxygen or temperature of said flue gas at at least one point along said gas path, said point chosen from the group consisting of entrance to secondary chamber, entrance of flue gas channel, entrance of gas side of steam generator, any position along said gas path, or plurality, or combination thereof.

Process according to this invention can further comprise the step of rotating of said hinged obstacle to a position depending on measurements of process parameters of said flow such as percentage of oxygen or temperature of said flue gas at at least one point along said gas path, said point chosen from the group consisting of entrance to secondary chamber, entrance of flue gas channel, entrance of gas side of steam generator, any position along said gas path, or plurality, or combination thereof.

Process according to this invention can further comprise the step of arranging a hinged obstacle in or in proximity to primary chamber.

During or after of oxidation of predominant part of said synthesis gas, the resulting heat is transferred to structure through which said of synthesis gas or air or flue gas or mixture thereof is flowing. Main portion of said heat transfer is achieved in part of the structure called flue gas channel which follows said secondary chamber.

The solution is further described by means preferred embodiment and of figures, said figures forming part of these specifications, and representing:

FIG. 1 shows velocity field as computed by available computational fluid mechanics means without obstacles showing areas of high flow velocities, and areas of low flow velocities, and providing for assessment of predetermined points in which at least one obstacle can be placed.

Figure 2:
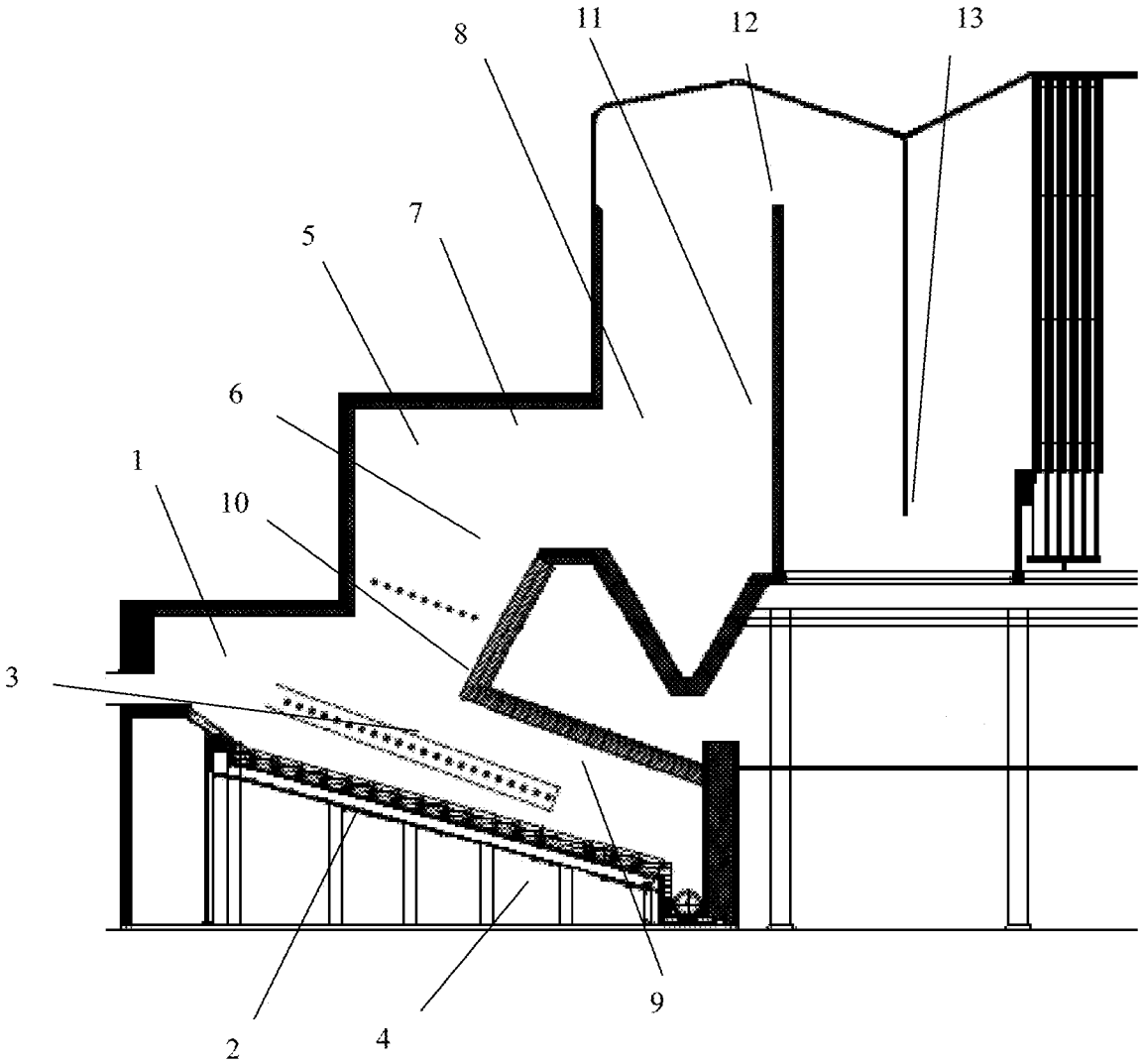
FIG. 2 shows cross section of RDF application without any obstacles.

FIG. 2 shows cross section of RDF application without any obstacles presenting primary chamber (1), grate, preferably moving (2), input of primary air (3), input of recirculation air (4), secondary chamber (5), input for secondary air (6), input for tertiary air (7), flue gas channel (8), position of increased velocity (9), (10), (11), (12), (13).

Figure 3:
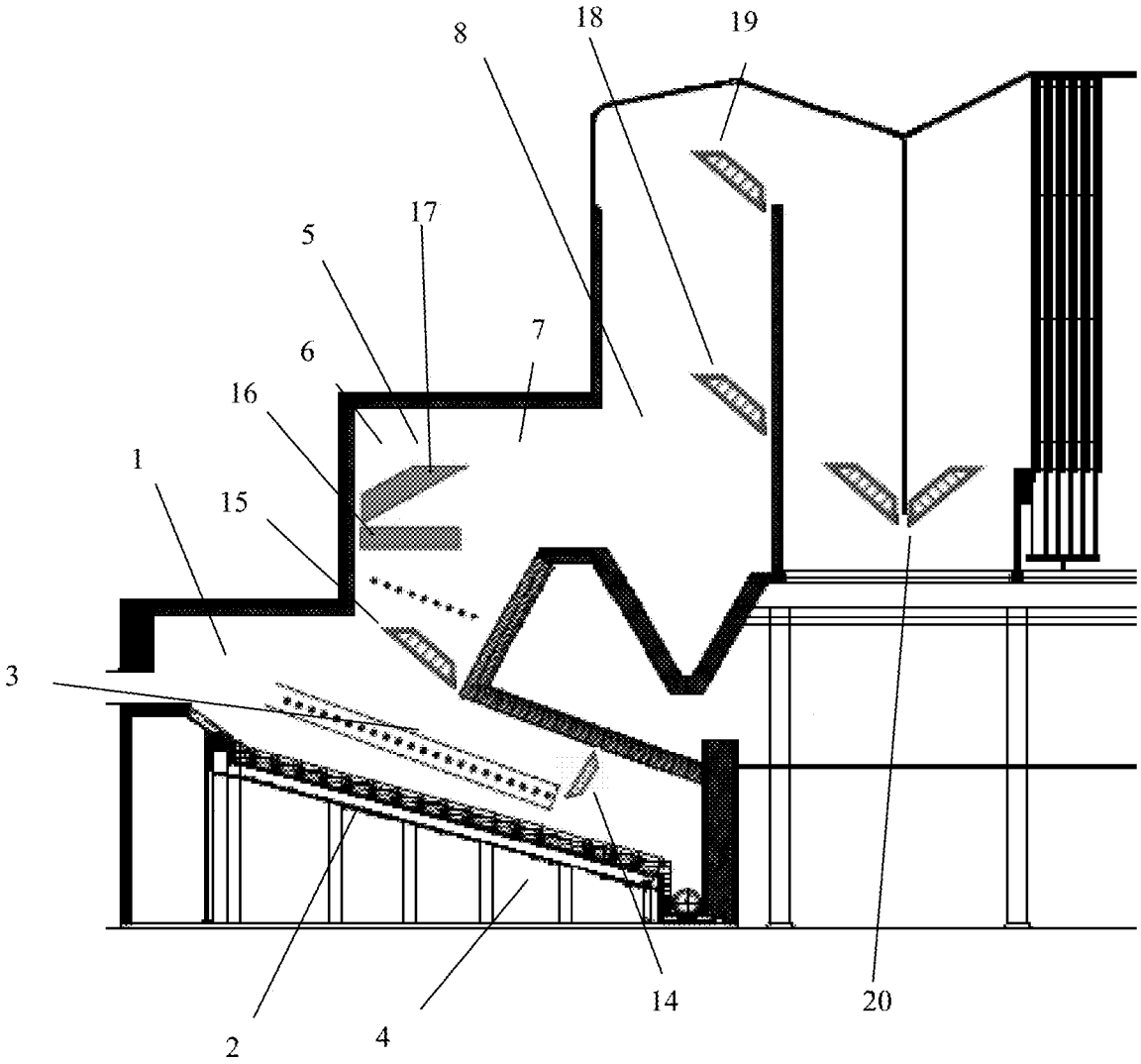
FIG. 3 shows cross section of RDF with obstacles in accordance with an illustrative embodiment.

FIG. 3 shows cross section of RDF with obstacles presenting primary chamber (1), grate, preferably moving (2), input of primary air (3), input of recirculation air (4), secondary chamber (5), input for secondary air (6), input for tertiary air (7), flue gas channel (8), unhinged flap (14), hinged flap of primary chamber (15), flaps of secondary chamber (16, 17), flaps of flue gas channel (18), (19), (20).

In the preferred embodiment, RDF application is a waste incinerator with basic construction of primary chamber (1) comprising moving or classic grate (2) with possibility of angle setting between 12-28° depending on process parameters such as content of flued and other conditions. On this grate (2) the fuel is being arranged while primary (3) and recirculation air (4) enters below or at the side, or plurality thereof, of said grate (2), said air being in quantity necessary to provide for gasification.

Above said grate (2) there is a secondary chamber (5). Therein, secondary (6) and tertiary (7) air enter. In order to provide for effective mixing, inlet nozzles may cause local increase of velocity of mixture of gases, for example in positions (9), (10), (11), (12), (13).

Between primary (1) and secondary (5) chamber there is a transition wherein increase in local velocity of said gases occur. This causes premature entrance of part of synthesis gas into said secondary chamber (5), and increase in solid particle concentration in said gases. In order to mitigate this situation, two obstacles are foreseen. The first (15) is a hinged gate (obstacle) which can be rotated in position most suitable for preventing non-uniformity of said flow field depending on measured parameters of the flow field or depending on experience of an operator.

Obstacles according to this invention can take many forms such as plates, flaps, grates, bumps, waves, rods, pins or similar devices causing disturbance of flow field aimed at reduction of peak velocities of said synthesis and/or flue gas, or mixture thereof.

With appropriate rotation of said hinged obstacle (e.g. 15) which can also depend on quality of RDF or moisture content one can provide for optimum position which prevents or reduces transfer of solid particles. Said obstacle can be water cooled which can further increase efficiency of this invention.

There is additional obstacle foreseen in form of unhinged obstacle (14) of said primary chamber (1). This obstacle (14) prevents or reduces premature transport of synthesis gas with addition of primary air. Primary air is in this position used to achieve the legally prescribed TOC limit. Namely, in this—back and lower part of said grate (2) is usually addition of primary air more intense than elsewhere in primary chamber (1) due to burning off remains of RDF which must achieve minimal values of total organic carbon ("TOC"). Without such unhinged obstacle there would be premature transfer of said gases into the middle section of said primary chamber (1) resulting in lower rate of gasification and increase of solid particle concentration.

Entrance into secondary chamber (5) shows similar characteristics as in primary chamber (1), however, there are materials added to the upper part of the grate (2) in order to reduce abrasive properties of said gases including solid particles. These gases are rapidly combusting, prompting said obstacle (15) which is water cooled. Further, in said secondary chamber (6) the velocities are the highest and most critical. Therefore, a double directing flaps (16,17) are foreseen there. These flaps (16 and 17) are meant to be pivotable, and are water cooled, and can be fixed in any predetermined position. Further, the flue gas channel is equipped with further obstacles in form of flaps (18), (19), (20) (18 and 19 and 20 are water cooled and pivotable). For purposes of these specifications words such as hinged, pivotable or rotatable refer to same characteristics of said obstacle (such as flap or similar), namely ability to position itself within said flow of synthesis gas, flue gas, air, or mixture thereof to induce at least one vortex, said vortex causing better steps chosen from the group containing mixing of gases, generating of synthesis gas, oxidation of said synthesis gas, heat transfer from said synthesis gas or said flue gas onto adjacent structure such as steam generator or similar.

The device according to this invention is comprised of at least one obstacle wherein said obstacle is chosen from the group containing:

- unhinged obstacle (14), preferably water cooled, for inducing at least one vortex in said primary chamber (1);
- hinged obstacle (15), preferably water cooled, for inducing at least one vortex in either said primary chamber (1), said secondary chamber (5) or both chambers (1), (5);
- hinged obstacle (16, 17), preferably water cooled, for inducing at least one vortex of synthesis gas or air or flue gas or mixture thereof in said secondary chamber (5);
- hinged obstacle (18, 19, 20), preferably water cooled, for inducing at least one vortex of synthesis gas or air or flue gas or mixture thereof in flue gas channel.

As a result of these inventions one encounters much better ecological parameters such as carbon monoxide and TOC with expected values under 1 mg/Nm3 which essentially means total decomposition of organic matter. Due to above referenced obstacle placement one also expects significant reduction in solid particle concentration, and reduction of dioxins, furans, (PCDD/F) during de novo synthesis.

Further, direct results are seen also due to reduction of need for additives during cleaning stage due to reduction of solid particle concentration.

Although this invention has been described and illustrated in the above, it is not limited to the above-mentioned practice, and any person with a general knowledge in the field to which this invention belongs will be able to carry out various variations and such changes will be within the scope of the claim.

As used herein, the phrase "a number" means one or more. The phrase "at least one of", when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

The description of the different illustrative embodiments has been presented for purposes of illustration and description and is not intended to be exhaustive or limited to the embodiments in the form disclosed. Many modifications and variations will be apparent to those of ordinary skill in the art. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for improving flow of synthesis and/or flue gas in refuse derived fuel (RDF) system or waste incinerator, the method comprising the steps of:

providing for assessment of local velocity profile of synthesis and/or flue gas flowing at a predetermined position within primary and/or secondary chamber;

if said assessment results in excess local velocity difference of said synthesis and/or flue gas in direction essentially transverse to general direction of flow of said synthesis and/or flue gas above a predetermined value, providing for obstacle to be placed at or in proximity to said predetermined position;

measuring of process parameters of said flow including percentage of oxygen or temperature of said flue gas or composition of RDF or moisture content or combination thereof at least one point along said gas path, said point chosen from the group consisting of entrance to secondary chamber, entrance of flue gas channel, entrance of gas side of steam generator, any position along said gas path, or plurality, or combination thereof;

arranging at least one hinged obstacle in the flue gas channel;

rotating of said at least one hinged obstacle to a position depending on measurements of process parameters of said flow including percentage of oxygen or temperature of said flue gas or composition of RDF or moisture content or combination thereof at at least one point along said gas path, said point chosen from the group consisting of entrance to secondary chamber, entrance of flue gas channel, entrance of gas side of steam generator, any position along said gas path, or plurality, or combination thereof, or depending on experience of an operator;

wherein an additional hinged obstacle is arranged in or in proximity to primary chamber; or the additional hinged obstacle is arranged in or in proximity to secondary chamber; and wherein an additional obstacle in form of an unhinged obstacle is arranged in the primary chamber.

2. A device for improving flow of synthesis and/or flue gas in refuse derived fuel (RDF) system for carrying out process according to claim 1, wherein the said device comprises of at least one obstacle wherein the said obstacle is suitably positioned in a flue gas channel.

3. The device according to claim 2, wherein the said device comprises of at least one unhinged obstacle positioned in or in proximity of a primary chamber or in proximity of a secondary chamber or in proximity of the flue gas channel.

4. The device according to claim 2 or 3, wherein said at least one obstacle is water cooled.

5. The device according to claim 2 or 3, wherein said at least one obstacle is chosen from the group comprising:

an unhinged obstacle configured to induce at least one vortex in said primary chamber;

a hinged obstacle configured to induce at least one vortex in either said primary chamber, said secondary chamber or both chambers;

a hinged obstacle configured to induce at least one vortex of synthesis gas or air or flue gas or mixture thereof in said secondary chamber;

a hinged obstacle configured to induce at least one vortex of synthesis gas or air or flue gas or mixture thereof in flue gas channel.

* * * * *